United States Patent [19]

Guice

[11] Patent Number: 4,678,209

[45] Date of Patent: Jul. 7, 1987

[54] CASING HANGER

[75] Inventor: Walter L. Guice, Houston, Tex.

[73] Assignee: Vetco Offshore, Inc., Ventura, Calif.

[21] Appl. No.: 789,681

[22] Filed: Oct. 21, 1985

[51] Int. Cl.[4] ..... F16L 21/00

[52] U.S. Cl. ..... 285/144; 285/146; 285/178; 285/350; 285/147; 277/188 R; 175/423

[58] Field of Search ..... 285/144, 145, 146, 147, 285/148, 178, 348, 419, 350, 391; 188/67; 175/422 WS; 166/85; 277/188 R, 188 A, 165

[56] References Cited

U.S. PATENT DOCUMENTS

| | | | |
|---|---|---|---|
| 1,455,731 | 5/1923 | Kelly | 285/146 |
| 2,683,045 | 7/1954 | Brooks | 285/146 |
| 2,683,046 | 7/1954 | Allen | 285/146 |
| 3,051,513 | 8/1962 | Watts et al. | 285/147 |
| 3,096,554 | 7/1963 | Johnson | 285/147 |
| 3,257,130 | 6/1966 | Watts et al. | 285/147 |
| 3,367,002 | 2/1968 | Johnson | 285/144 |
| 3,994,517 | 11/1976 | Carmichael | 285/147 |
| 4,109,942 | 8/1978 | Morrill | 285/348 |
| 4,402,535 | 9/1983 | Bridges | 285/145 |

*Primary Examiner*—Cornelius J. Husar

*Assistant Examiner*—Eric K. Nicholson

*Attorney, Agent, or Firm*—Chilton, Alix & Van Kirk

[57] ABSTRACT

An improved casing hanger for suspending a pipe string from a casing head at a well head employs a plurality of slip members having a series of teeth which are adapted for frictionally engaging the wedging surface of a slip bowl. The teeth have a profile which gradually tapers in accordance with the distance from a central portion of the slip member. The slip member is deformable from a first configuration wherein the edges of one surface of the slip member engage the pipe string while the central portion of the surface is spaced from the pipe string and the opposite surface of the slip member has a central portion which engages the slip bowl with the ends of the outer surface being spaced therefrom to a loaded configuration wherein the surfaces of the slip member engage the pipe string and the slip bowl along a series of substantially continuous arcuate paths. A deformable wall structure is also disposed adjacent the sealing element so that in the event that the compressive force exerted by the seal element exceeds a pre-established threshold value. The wall deforms to relieve the compressive force exerted by the sealing element.

12 Claims, 7 Drawing Figures

CASING HANGER

BACKGROUND OF THE INVENTION (1) Technical Field of the Invention

This invention relates generally to the suspension of conduits and particularly to the hanging of "strings" of piping. More specifically, the present invention relates to a casing hanger employed for suspending and externally sealing a pipe casing in a well-head. Accordingly, the general objects of the present invention are to provide novel and improved methods and apparatus of such character.

Casing hangers employed for suspending and sealing a casing at a well head typically comprise a generally annular shaped slip bowl and a plurality of movable slip members. The slip members have inwardly projecting teeth which engage the pipe casing centrally received in the slip bowl as the slip members are forced downwardly in the slip bowl due to the load of the casing weight. An annular ring seal is disposed below the slip members between a lower peripheral shoulder of the slip bowl and a compression ring. The seal is automatically loaded against the casing as a result of the casing forcing the slips and slip bowl against the seal.

The suspension capacity of a casing hanger is ordinarily limited by a critical threshold which is related to the suspended casing weight. When this critical threshold is exceeded an excessive casing deflection or "bottle necking" phenomena develops at the slip members/casing interface due to the compressive load exerted on the casing by the slip members. As noted above, the applied load of the casing also causes compression of the seal carried by the hanger against the casing being suspended. When the seal is placed under excessive loads, the compressive forces exerted on the casing by the seal may actually deflect or crush the casing. Thus, the seal assembly of the typical casing hanger also provides a constraint on the weight which the slip members can carry before the system fails due to a reduction of the diameter of a casing. Further, the integrity of the seal established by the casing hanger can become problematic due to dimensional variations in the casing outside diameter and variations in the concentricity of the casing. The seal assembly is ordinarily configured so that, when the seal is fully loaded, the seal assembly seals against the smallest permissible casing diameter within the given size range for which the hanger assembly has been designed. However, when the same seal is also employed for sealing against the largest diameter casing which the hanger assembly can accommodate extremely high compressive stresses may be exerted against the casing by the seal assembly.

It is, accordingly, a principal aim of the present invention to provide a new and improved casing hanger and casing suspension method which control the compressive load placed on a suspended casing by the casing engaging slip members and which also provide a sealing means for accommodating variations in casing diameter and concentricity without exerting an excessive load against the casing.

(2) Prior Art

U.S. Pat. No. 2,824,757 discloses a pipe suspension and sealing system which includes means to limit compression of the seal of a casing hanger. The hanger automatically seals with the well head in which the hanger is seated when pipe weight is applied to the hanger. A load limiting structure is incorporated into the pipe suspension assembly so that only a portion of the casing weight transferred by the slips is applied to the material which forms the seal to prevent the seal material from being placed under excess compression.

Another commercially available casing hanger employs slip members which are precision machined with sharp inner teeth. The teeth are adapted to provide a positive bite to hold the casing securely. In addition, dull outer teeth are precision machined at the back of the slip members and extend uniformly from side to side in parallel fashion for contacting the slip bowl to automatically control the slip member/slip bowl friction so that the friction increases as the casing load increases and the downward slip member travel ceases before damage to the casing can occur.

BRIEF SUMMARY OF THE INVENTION

Briefly stated, the invention in a preferred form is an improved casing hanger for suspending a pipe string or the like. The casing hanger of the invention comprises a slip bowl adapted for seating in a casing hanger. A plurality of slip members are disposed in circumferential spaced relationship in the slip bowl and define a central pipe casing receiving bore. The slip members are adapted for wedging movement downwardly and inwardly for engagement with the exterior of a pipe string disposed in the bore to support the pipe string therein. The slip members have an inner surface with a first series of teeth adapted for engagement with a received pipe string and also have opposing outer surfaces with a second series of teeth adapted for engagement with wedging surfaces in the slip bowl. The second series of teeth has a tapered tooth profile wherein the teeth protrude at an increasing radial distance from said slip member outer surfaces in accordance with the circumferential distance from the center portion of the slip members. The slip members have a bowed configuration when the casing hanger is unloaded so that initially the side edges of the inner surface enage an inserted pipe string while the central portion thereof is spaced from the pipe string. Also, in this bowed configuration, a central portion of the outer surfaces of each slip member engages a slip bowl wedging surface while the side edge portions of the outer surfaces are spaced from the slip bowl. During loading the slip members deform to engage the pipe string and the slip bowl along a series of continuous arcuate paths at the inner and outer surface of the slip members.

In the preferred embodiment of the invention a compression ring is coupled to the slip bowl and is capable of limited movement relative thereto. The compression ring cooperates with the slip bowl to define two pairs of facing shoulders. A sealing element is disposed between the shoulders of each pair. One of these sealing elements is adapted for radially sealingly enaging the pipe string. Upon application of a compressive load against the shoulders a deformable wall adjacent the sealing elements deforms to relieve the compressive force exerted by the sealing element when the compressive force exceeds a pre-established threshold level. The deformable wall may extend from the compression ring and have a generally annular shape disposed co-axial with the axis of the casing hanger bore. The deformable wall may also be partially defined by a sealing element engaging shoulder of the compression ring or a sealing element engaging shoulder of the slip bowl.

DETAILED DESCRIPTION OF THE INVENTION

Figure 1:
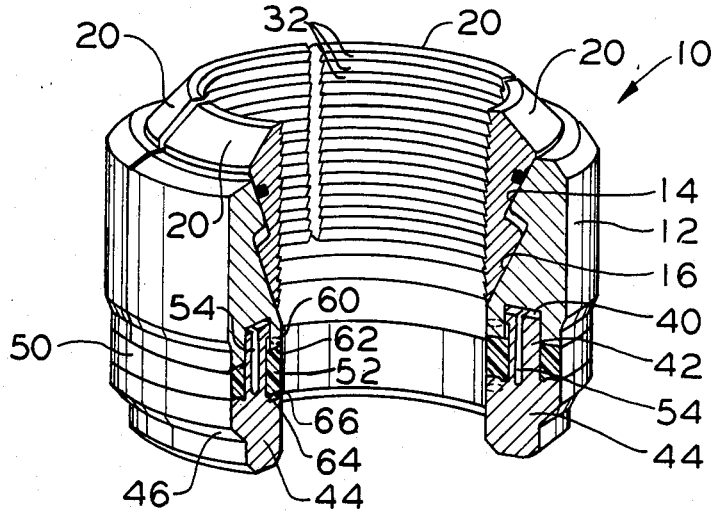
FIG. 1 is a fragmentary side perspective view of a casing hanger in accordance with the present invention.

With reference to the drawing, wherein like numerals represent like parts throughout the several FIGURES, a casing hanger in accordance with the present invention is generally designated by the numeral 10. Casing hanger 10 is exteriorly configured so that the hanger may be landed in a casing head (not illustrated) for suspending a pipe string (not illustrated) at a well head.

Casing hanger 10 includes a slip bowl 12 formed by two semi-cylindrical members. The slip bowl defining members are exteriorly dimensioned and configured for close receptive accommodation within the upper bore of a well casing head for seating therein. The interior surface of slip bowl 12 forms a pair of vertically spaced downwardly and inwardly inclined frustoconical wedging surfaces 14 and 16.

Figure 2:
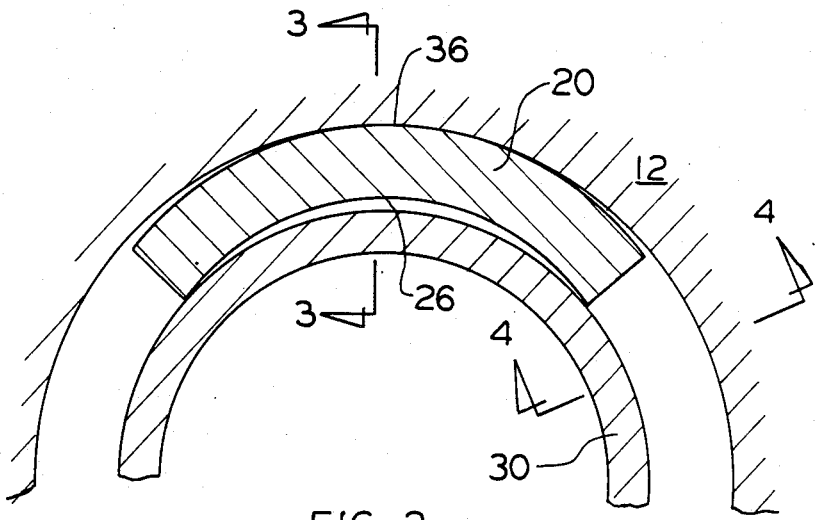
FIG. 2 is a fragmentary top sectional view of the casing hanger of FIG. 1.
Figure 3:
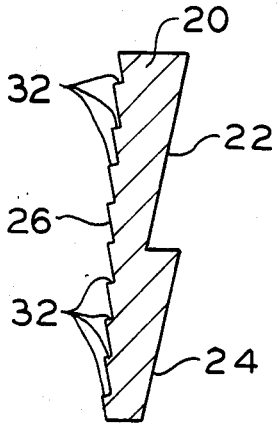
FIG. 3 is a side sectional view of a slip member of the casing hanger of FIG. 2 taken along the line 3—3 thereof.
Figure 4:
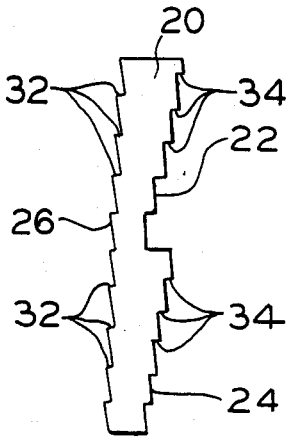
FIG. 4 is a end view of a slip member of FIG. 2 taken along the line 4—4 thereof.

A plurality (commonly four or six) of segmental slip members 20 are received in slip bowl 12. The slip members 20 each have a pair of outer vertically spaced, quasi-frustoconical wedging surfaces 22 and 24 which are respectively generally complementary in shape to and engageable with surfaces 14 and 16 of the slip bowl 12. With reference to FIGS. 2 through 4, each slip member also has an inner quasi-cylindrical surface 26. In the unloaded state the inner quasi-cylindrical surface 26 is bowed so that only the opposite vertical edges thereof contact the cylindrical casing 30 of the pipe string while the central portion of the inner surface of the slip member is spaced from the exterior surface of the casing. In opposite fashion, the center region of the outer surfaces 22, 24 of the slip member contact and slip bowl along a substantially linear vertical path while the side edges of the outer surfaces are spaced from the cooperating inner surfaces 22 and 24 of the slip bowl.

A series of teeth 32 are formed at the inner surface 26 of each the slip members to define a serrated surface. Teeth 32 extend between opposing sides of the slip member to form a vertical series of parallel teeth having an arcuate profile. The teeth 32 have relatively sharp edges which are adapted for forceably engaging the exterior of the casing 30 to thereby frictionally engage and suspend the casing. Each of the teeth 32 has a substantially uniform section throughout its arcuate extent.

A second series of substantially parallel teeth 34 are formed in the outer exterior surfaces 22 and 24 of slip members 20. Teeth 34 are configured so that the tooth profile gradually varies radially in symmetric fashion from substantially zero depth at the center 36 of the slip member outer surface, as illustrated in FIG. 3, to a well defined protruding tooth profile at each side edge of the slip member as best illustrated in FIG. 4. The foregoing tooth profile may be obtained by moving a slip member 20 off-center and machining a cut in the rear face of the member so that the cut is tangential to the rear face in the direction that the center has been displaced. The foregoing is accomplished by electronically controlled precision machining which results in the slip members having the full depth cut at the outer ends and the zero depth profile at the center as illustrated by the contrasting sections of FIGS. 3 and 4.

As the slip members are forced downwardly in the slip bowl 12 by the weight of a casing 30 received therein, each of the slip members flattens or deforms from the bowed configuration of FIG. 2 so that the center portions of the slip members are eventually brought into face-to-face engaging relationship with the casing. It should be appreciated that initially only the outer portions of the teeth 32 engage the casing and as the loading increases eventually virtually the entire arcuate extent of each of the teeth will be forced into engaging continuous biting relationship with the casing. Because the central portion of the outer surface of the slip members has no or minimal radial tooth protrusion, initially the slip moves easily relative to the slip bowl until the weight of the casing and the flattening of the slip members result in the outer edge portions of the teeth 34 engaging or biting into the slip bowl. During the make-up phase, i.e., from the time the slip members first contact the casing until they are fully engaged, increasingly high frictional forces are required. High frictional forces are required because the vertical component of those forces in effect exert the radial forces which support the suspended casing. The higher a vertical force that may be developed for a given radial force, the higher the casing weight that can be supported without compressive failure. Thus, the foregoing slip member configuration provides a means for positively controlling the coefficient of friction between the slip members and slip bowl in the casing hanger so that greater casing weights may be suspended without excessive bottle necking or deflection of the casing in the slip area.

The lower portion of each of the slip bowl defining members includes a circumferentially extending arcuate slot 40. Slot 40 is adapted to receive arcuate tongues 42 extending upwardly from associated lower members 44 of a segmented compression ring. Ring defining members 44 preferably correspond in number to the number of members forming the slip bowl. The compression ring has a downwardly facing exterior frustoconical surface 46 for engaging the seat of the casing head (not illustrated). The tongue and groove connection between the slip bowl and compression ring permits a limited amount of relative vertical movement between these components. A pair of annular sealing elements 50 and 52 are interposed between shoulders at the lower end of the slip bowl and facing shoulders defined by the members 44.

In a preferred embodiment an annular axially extending slot 54 is formed in the tongues 42 of the compression ring defining members 44. The wall 58 between the seal element 52 and the slot 54 has a pre-established thickness and rigidity whereby the wall does not deform or deflect under the influence of a normal sealing load when the weight of the casing forces the lower peripheral shoulder of the slip bowl toward the facing shoulder of the compression ring to compress the seal elements 50 and 52 respectively into radial engagement with the casing and the casing hanger.

Figure 5:
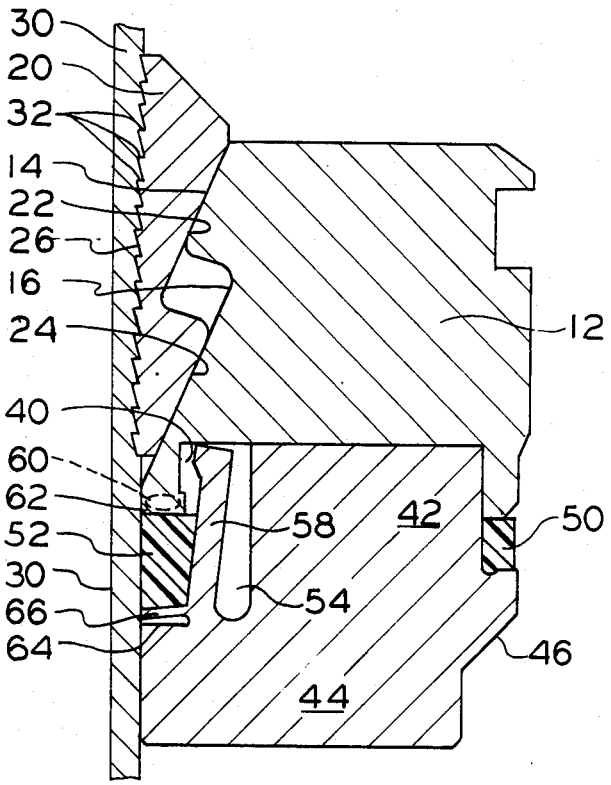
FIG. 5 is an enlarged fragmentary sectional view illustrating a casing suspended by the hanger of FIG. 1.

With reference to FIG. 5, in the event that the compression of the seal elements exceeds a pre-established threshold level required for sealing, the wall 58 will be radially deflected or displaced into the slot 54 to accommodate the radially expanded seal element and thereby prevent crushing of the casing. Ordinarily, air at atmospheric pressure occupies the slot 54. It should be appreciated that the above-described wall/slot configuration relieves the very high compressive forces that would otherwise be introduced into the casing from the seal. In instances where relatively large diameter casings are employed the ring loading in the casing ordinarily adds directly to the loading caused by the slip members due to the proximity of the seal element to the lower end of the slips.

In an alternative embodiment, an annular slot 60 (illustrated in dashed lines) may be milled in addition or in the alternative to slot 54 to form a deformable wall 62. Slot 60 extends circumferentially around the slip bowl and is serially partially defined by shoulder the lower which engages the sealing element. In yet a third embodiment of the invention, an annular slot 64 may be milled into compression ring to form a deformable wall 66 adjacent the upper shoulder which contacts the sealing element. In each of the embodiments, the deformable walls are configured to deflect or deform into the adjacent slots to accommodate the compressed sealing element in the event that the force exerted by the seal against the casing becomes excessive.

Figure 6:
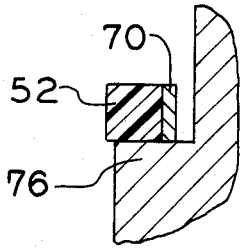
FIG. 6 is an enlarged fragmentary sectional view illustrating an alternate seal configuration for a casing hanger in accordance with the present invention.

With reference to FIG. 6, the seal element 52 is surrounded by a thin walled metallic cylinder 70. Cylinder 70 is a deformable member which is not integral with the rest of the slip bowl or compression ring and is dimensioned so that an annular expansion cavity accommodates the radial expansion of the cylinder. As the loading on the seal element 52 approaches the preestablished maximum seal pressure, the cylinder 70 expands radially into the cavity so that the seal engagement yields at the maximum seal pressure.

Figure 7:
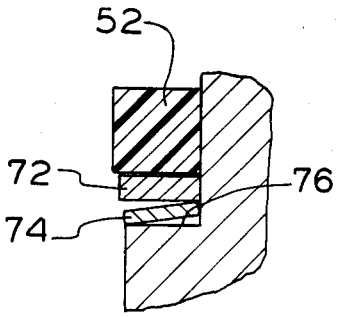
FIG. 7 is an enlarged fragmentary sectional view illustrating yet another seal configuration embodiment for a casing hanger in accordance with the present invention.

With reference to FIG. 7, the seal element 52 is mounted above a backup washer 72. A belleville spring 74 is positioned between backup washer 72 and shoulder 76 of the compression ring. The belleville spring 74 deforms to relieve the compressive force exerted by the sealing element when the compressive force exceed a preestablished threshold level.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and scope of the present invention.

I claim:

1. An improved casing hanger for suspending an inner pipe string or the like from an interior seat of a casing head comprising:

a slip bowl forming an exterior seat for engaging the interior seat of a casing head and forming an inner wedging surface defining a central opening therein;

slip means disposed in circumferentially spaced relation about said opening and forming a central bore for wedging movement downwardly and inwardly with respect to said wedging surface into engagement with the exterior of a pipe string disposed in said bore to support the pipe string therein, said slip means comprising a plurality of slip members having an inner surface with a series of teeth engageable into a pipe string disposed in said bore and having an opposing outer surface with a second series of teeth engageable with the slip bowl wedging surface, said second series of teeth having a tapered tooth profile wherein said teeth protrude at an increasing radial distance from said outer surface in accordance with the distance from a central outer surface portion of said slip member.

2. The casing hanger of claim 1 wherein the central outer portion of each said slip member forms a substantially smooth surface.

3. The casing hanger of claim 1 wherein slip members have inner and outer surfaces which extend between opposing ends to form edges with said surfaces, said slip members being bowed in a first configuration so that the edges of the inner surface engage a pipe string with the central portion thereof being spaced from said pipe string in non-engagement relationship and a central portion of the outer surface and said slip member engages said slip bowl wedging surface with the ends thereof being spaced from said slip bowl in non-engaged relation thereto.

4. The casing hanger of claim 3 wherein each said slip member deforms to engage said pipe string and said slip bowl along a series of continuous arcuate paths at the inner and outer surfaces of said slip members.

5. The casing hanger of claim 1 wherein slip members have inner and outer surfaces which extend between opposing ends to form edges with said surfaces, said slip members being bowed in a first configuration so that the edges of the inner surface engage a pipe string with the central portion thereof being spaced from said pipe string in non-engagement relationship and a central portionof the outer surface of said slip member engages said slip bowl wedging surface with the ends thereof being spaced from said slip bowl in non-engaged relation thereto.

6. The casing hanger of claim 5 wherein said deformable wall means comprises a wall which extends from said compression ring and has a generally annular shape disposed coaxially with the axis of the bore.

7. The casing hanger of claim 5 wherein said deformable wall means comprises a deformable wall which is partially defined by the shoulder of said compression ring.

8. The casing hanger of claim 5 wherein said deformable wall means comprises a wall which is formed in said slip bowl and is partially defined by the slip bowl shoulder.

9. The casing hanger of claim 5 wherein said deformable wall means comprises a deformable cylinder.

10. An improved casing hanger for suspending an inner pipe string or the like from the interior seat of a casing head comprising:

a slip bowl forming a ring having a central pipe string receiving bore therein and an exterior seat for engaging the interior seat of the casing head with a lower peripheral portion of said ring forming a shoulder;

a plurality of arcuate slip members disposed in circumferentially spaced relationship about said bore and forming an opening, said members being disposed for wedging movement downwardly and inwardly into engagement with the exterior casing of a pipe string disposed in said opening to support the pipe string;

a compression ring having a shoulder disposed in spaced relationship with said slip bowl shoulder, said compression ring cooperating with said slip bowl so as to provide a limited degree of movement between said shoulders;

a sealing ring disposed between said shoulders and radially expandable to compressively sealingly engage the pipe string casing upon application of a compressive load between said shoulders; and deformable wall means adjacent said sealing ring in generally concentric relationship therewith for deforming upon radial expansion of said seal ring to relieve the compressive force exerted by said sealing means when the compressive force exceeds a pre-established threshold level.

11. The casing hanger of claim 10 wherein said deformable wall means comprises a deformable cylinder.

12. The casing hanger of claim 10 wherein said deformable wall means is formed from metal.

* * * * *

UNITED STATES PATENT AND TRADEMARK OFFICE

CERTIFICATE OF CORRECTION

PATENT NO. : 4,678,209

DATED : July 7, 1987

INVENTOR(S) : Walter L. Guice

It is certified that error appears in the above-identified patent and that said Letters Patent is hereby corrected as shown below:

Claim 3, line 8 (column 6, line 24) change "and" to --of--

Cancel claim 5 and substitute therefor the following:

Claim 5. An improved casing hanger for suspending an inner pipe string or the like from the interior seat of a casing head comprising:

a slip bowl forming a ring having a central pipe string receiving bore therein and an exterior seat for engaging the interior seat of a casing head with a lower peripheral portion of said ring forming a shoulder;

a plurality of arcuate slip members disposed in circumferentially spaced relationship about said bore and forming an opening, said members being disposed for wedging movement downwardly and inwardly with respect thereto into engagement with the exterior casing of a pipe string disposed in said opening to support the pipe string;

It is certified that error appears in the above-identified patent and that said Letters Patent is hereby corrected as shown below:

a compression ring having a shoulder disposed in spaced relationship with said slip bowl shoulder, said compression ring cooperating with said slip bowl so as to provide a limited degree of movement between said shoulders;

sealing means disposed between said shoulders for compressively sealingly engaging the pipe string casing upon application of a compressive load between said shoulders; and deformable wall means formed in at least one of said compression ring and said slip bowl members adjacent said sealing means for deforming to relieve the compressive force exerted by the sealing means when the compressive force exceeds a

UNITED STATES PATENT AND TRADEMARK OFFICE

CERTIFICATE OF CORRECTION

PATENT NO. : 4,678,209

DATED : July 7, 1987

INVENTOR(S) : Walter L. Guice

It is certified that error appears in the above-identified patent and that said Letters Patent is hereby corrected as shown below:

preestablished threshold level.

Signed and Sealed this

Twelfth Day of April, 1988

*Attest:*

DONALD J. QUIGG

*Attesting Officer*

*Commissioner of Patents and Trademarks*